US007151840B2

(12) United States Patent
Lenhard-Backhaus et al.

(10) Patent No.: US 7,151,840 B2
(45) Date of Patent: Dec. 19, 2006

(54) MAGNET SYSTEM OF A SOUND TRANSDUCER

(75) Inventors: Hugo Lenhard-Backhaus, Vienna (AT); Ernst Stöttinger, Vienna (AT)

(73) Assignee: AKG Acoustics GmbH, Vienna (AT)

( * ) Notice: Subject to any disclaimer, the term of this patent is extended or adjusted under 35 U.S.C. 154(b) by 0 days.

(21) Appl. No.: 10/802,396

(22) Filed: Mar. 16, 2004

(65) Prior Publication Data

US 2004/0197005 A1 Oct. 7, 2004

(30) Foreign Application Priority Data

Mar. 17, 2003 (AT) ..... A 418/2003

(51) Int. Cl.
*H04R 25/00* (2006.01)

(52) U.S. Cl. ..... 381/396; 381/420; 381/433

(58) Field of Classification Search ..... 381/355, 381/357, 361, 177, 191, 395–398, 400, 401, 381/407, 409, 412, 415, 419–420, 424, 427, 381/433; 455/440; 181/171, 199; 29/594
See application file for complete search history.

(56) References Cited

U.S. PATENT DOCUMENTS

2003/0156732 A1* 8/2003 Hong ..... 381/409
2004/0105568 A1* 6/2004 Lee ..... 381/412

* cited by examiner

*Primary Examiner*—Suhan Ni
(74) *Attorney, Agent, or Firm*—Friedrich Kueffner

(57) ABSTRACT

A miniaturized electro-dynamic sound transducer has a housing made of deep drawn sheet metal. A magnet system with a magnet is arranged in the housing. A diaphragm provided with a coil is arranged in the housing, and wires extend from the coil to contacts. The housing has an outer diameter of maximally 20 mm. The thin sheet metal of the housing has an average thickness of maximally 0.2 mm. The magnet system has a lower pole piece and an upper pole piece, wherein the pole upper and lower pieces are made of sheet steel having a thickness of at least 1.5 times an average thickness of the bottom of the housing.

8 Claims, 1 Drawing Sheet

MAGNET SYSTEM OF A SOUND TRANSDUCER

BACKGROUND OF THE INVENTION

1. Field of the Invention

The invention relates to a magnet system of a miniaturized sound transducer operating according to the electrodynamic principle. The sound transducer comprises a housing of deep drawn sheet metal, a magnet system comprising a magnet, and a diaphragm provided with a coil having wires extending to a contact. Such transducers are, in particular, used in connection with small devices such as telephones, mobile phones, hands-free devices for telephones, headsets or the like. Such miniaturized electro-acoustic sound transducers are provided with a diaphragm and a moving coil fastened to the diaphragm, a diaphragm holder, a magnet system, and optionally a front cover and/or a rear cover. The invention also relates to a method for manufacturing such a transducer.

2. Description of the Related Art

Electro-acoustic sound transducers operating according to the dynamic principle have been known for almost 100 years and are used in connection with loudspeakers, headsets or in different acoustic applications, for example, as the speaker part of a telephone. They are simply referred to in the following as transducers.

The current construction of such a transducer includes essentially plastic materials, as described in the publications AT 211 150 B and AT 236 474 B, for example. Such solutions have enabled manufacture of a transducer where the diaphragm seat as well as the transducer housing and also the injection-molded enclosure of the magnet system and of the electrical contacts provide a compact unit. These solutions have contributed to the fact that a semi-automatic transducer production has become widely accepted in practice instead of the prior manual manufacture. This solution requires plastic material injection molding devices that are sometimes very complex and thus expensive. A fully automated manufacture of transducers has not been realized up to now because of the complex manipulation of the transducer components to be embedded in plastic material. Accordingly, the essentially technically very excellent solution of embedded components cannot be used in a cost-efficient way in mass production.

In principle, it is important in order to increase, on the one hand, the output level of the transducer as well as, on the other hand, to minimize the distortion of the reproduction, to make the strength of the magnetic field in the air gap of the transducer as large as possible and as linear as possible. The magnetic field strength in the air gap of the transducer is primarily dependent on the magnetic strength and the volume of the permanent magnets. The stronger and the larger the magnet, the more potential is provided by it. This potential however can be used only when the length of the magnet lines to the air gap and the material in which they extend do not weaken them too much. This is the second important factor in order to maximize the magnetic field strength. Generally, long and "thin" paths are always bad because they weaken the magnetic force lines while passing through the magnetic yoke. When the magnetic properties of the employed materials are known, the computation of the magnetic fields is very similar to the computation of electrical circuits.

The magnetic circuits for electro-acoustic transducers are designed such that, by using a relatively narrow annular air area (gap), a maximum of magnetic field strength is achieved. In the case of small transducers and "expensive space", the size of the magnet is very limited. All the more, the configuration of the magnetic yoke is important. In general, it is important that the yoke is not made unnecessarily thin. Therefore, magnet pot thickness of under 2 mm is considered bad and a thickness of under 0.5 mm is hardly usable because it causes too much loss. The same holds true also for the pole piece.

The second important role of the pole piece is to enable in the air gap of the acoustic transducer a magnetic field strength that is as linear as possible. This means that (in the transverse direction relative to the axis of symmetry, i.e., radially) the magnetic field distribution should be constant. Therefore, the pole piece has usually a thickness that matches approximately the stroke of the diaphragm. However, depending on the type and the application of the transducer, the stroke is between 0.5 mm and 2 mm. The moving coils are usually by 300% longer than the pole flange thickness. This is necessary in order to enable that even for extreme amplitudes of the diaphragm the coil is still positioned with at least one-third of its length within the air gap.

In the case of transducers having a diameter of more than 10 centimeters, it is therefore conventional to manufacture the housing by deep drawing sheet metal of a suitable thickness, usually a thickness of approximately 2 mm. The invention relates to miniaturized transducers having a diameter of less than approximately 20 mm; this does not allow for use of such sheet metal thickness for deep drawing. The use of thin sheets however is not indicated because of the aforementioned problems so that despite the resulting problems the aforementioned plastic housings are still employed.

SUMMARY OF THE INVENTION

It is an object of the present invention to change the mechanical configuration of the transducer such that a completely automated production of the transducer, in particular, of very small transducers up to a diameter of less than 10 mm, is possible without great expenditure and without decreasing the quality of the transducer.

In accordance with the present invention, this is achieved in that in the case of a transducer of the aforementioned kind, the housing having an outer diameter of maximally 20 mm is comprised of thin sheet steel having an average thickness of maximally 0.2 mm, in that the magnet system comprises a lower pole piece and an upper pole piece, and in that the pole pieces are comprised of sheet steel having a thickness of at least 1.5 times the average thickness of the bottom of the housing. In this way, it is possible to produce the housing inexpensively by deep drawing and, by reinforcing the bottom area by means of the lower pole piece, to accept the weakening of the field strength within the wall area and to achieve instead a miniaturization that is as large as possible.

The term "average thickness" is required because of the differences occurring in the wall thickness at different locations of the finished housing as a result of deep drawing of the housing.

In one embodiment of the invention, it is provided that the pole pieces have a thickness of at least 1.5 times, preferably of at least twice, in particular three times the average thickness of the bottom of the housing. In this way, in the area of the moving gap a particularly homogenous magnetic field is achieved and weakening of the magnetic field as a result of the minimal thickness of the housing is further reduced.

According to one variant, it is proposed that the lower pole piece is a part of, particularly a monolithic part of, the magnet pot whose peripheral area extends at least essentially up to the upper surface of the upper pole piece. This variant, that provides a degree of miniaturization of the transducer that is only minimally less than in the prior variant, has the advantage of a practically unweakened magnetic field.

A further embodiment of the last mentioned variant is characterized in that the wall thickness of the magnet pot corresponds to at least 1.5 times, preferably at least 2 times, particularly preferred at least 3 times, the average thickness of the bottom of the housing. Accordingly, in the area of the moving gap a particularly homogenous magnetic field is obtained.

The method according to the invention for manufacturing a transducer according to the invention that has a lower pole piece is characterized in that the lower pole piece during deep drawing of the housing is inserted like a lost core into the deep drawing mold. In this way, despite the reduced dimensions of all participating parts, a simple manipulation is enabled. Moreover, this results in a reliable fixation of the pole piece without gluing or the like.

The method according to the invention for manufacturing a transducer according to the invention having a magnet pot is characterized in that the magnet pot for deep drawing the housing is inserted like a lost core into the mold. The advantages are the same as in the aforementioned method.

DESCRIPTION OF THE PREFERRED EMBODIMENTS

Figure 1:
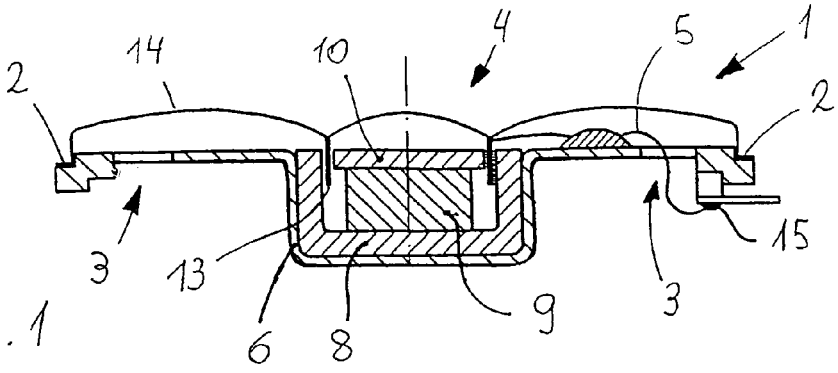
FIG. 1 shows a transducer according to the present invention.

The solution according to the invention is illustrated in principle with the aid of FIG. 1. The transducer 1 of the present invention is comprised of a sheet steel housing 6 that is deep drawn and stamped so that a diaphragm mounting surface 2 for the diaphragm 14 is provided as well as rear sound openings 3 and the mounting recess for a magnet system 4. Furthermore, the deep drawn and stamped housing enables connecting wires 5 of a coil 13 to be guided to connecting contacts 15.

The use of sheet metal for the manufacture of transducers as mentioned above, is essentially known in the prior art and has been used for a long time for producing loudspeakers. Since the relatively large diameter of at least several decimeters of a loudspeaker allows the use of thicker sheet steel, it is possible with regard to the manufacturing process to configure the magnetic yoke (magnet and pole piece), directly with the pot-shaped sheet steel of the loudspeaker housing. Since the employed sheet steel is of a thickness of up to two mm, it has no negative effect on the strength of the magnetic field in the air gap of the magnet system. Use of thinner sheet steel drastically reduces the magnetic field strength in the air gap of the magnet system, and accordingly the efficiency of the loudspeaker.

Figure 2:
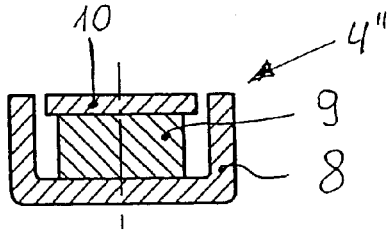
FIG. 2 is an enlarged detail of FIG. 1.

Modern telecommunication devices such as mobile phones and the like require transducers that are to be made smaller and smaller and, in an extreme situations, they have a diameter that is even smaller than 10 mm. In order to enable manufacture of such transducers in an inexpensive way, it is suggested according to the invention to combine a magnet system (as illustrated in FIG. 2) that is comprised of a pot 8, a magnet 9, and pole piece 10, with a deep drawn sheet metal housing. In this way, it is possible to employ thin sheet metal, up to 0.2 mm, without magnetic field losses in the air gap because the magnetic circuit is comprised of a "thicker" magnet pot.

In another embodiment (illustrated in FIG. 4) that is even simpler, only a second pole piece is provided instead of the pot 8. In this configuration, in comparison to the embodiment of FIG. 3, a reduced magnetic flux is obtained but a greater miniaturization is enabled. The magnetic flux can be imagined such that the magnetic force lines extend from the bottom of the magnet 9 via the lower pole piece 11 and via the thin sheet metal housing 6 up to the air gap in the upper part and via the upper pole piece 10 (FIG. 2) back into the magnet 9. Of course, they are weakened more on their path through the thin sheet metal instead of through the thick-walled pot 8, but for transducers that are especially small this is acceptable.

Figure 3:
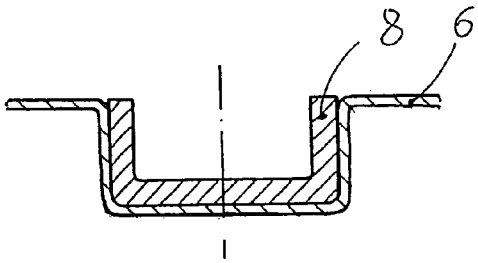
FIG. 3 is a detail of the course of manufacture.
Figure 4:
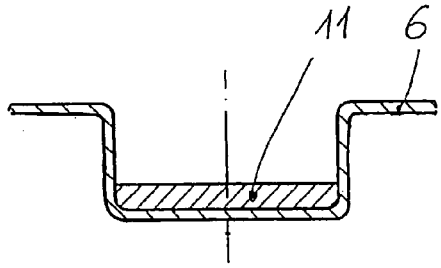
FIG. 4 is a variant of FIG. 3.

The invention proposes as a preferred manufacturing method, as illustrated schematically in FIG. 3 or FIG. 4, to introduce the pot 8 or the lower pole piece 11 into the deep drawing mold during deep drawing of the housing 6, and to deep draw it together with the sheet metal of the housing. In this way, a fixed connection, free of any adhesive, is provided between the pot 8 or the lower pole piece 11 of the magnet system and the remaining housing parts 6 of the transducer 1.

Figure 5:
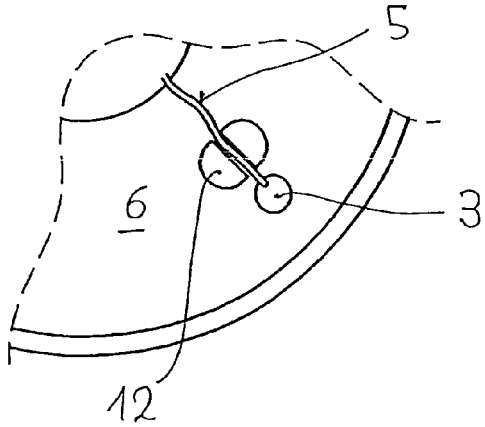
FIG. 5 shows the guide of the wires of the coil.

FIGS. 1 and 5 show that a transducer housing 1 deep drawn from thin sheet steel also has openings 3. They are needed for the necessary acoustic tuning of the transducer and are known to a person skilled in the art of electro-acoustics; they can be easily determined with regard to their number, size, and position.

A praxis-oriented magnet yoke according to the invention of a small transducer has a magnet of 0.9 mm thickness, a pole piece of 0.3 mm thickness, and a magnet pot of 0.4 mm thickness. This magnet pot is secured in a transducer housing (FIG. 1, part 6) of a thickness of 0.2 mm.

Figure 6:
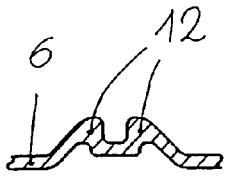
FIG. 6 shows a detail of the guide of the wires.
Figure 7:
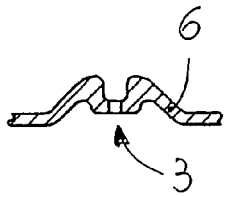
FIG. 7 shows another view of the guide according to FIG. 6.

In this connection, the invention proposes also an improvement of guiding the wires 5 from the coil to the contacts. As illustrated schematically in FIG. 5, during the course of deep drawing, two projections 12 are formed in the exterior area of the transducer housing 6 in the area of the opening 3, through which projections the wires 5 are guided. The wires 5 can be guided through the space between these projections and can be secured there at optionally by an adhesive. FIG. 6 shows, purely schematically and not to scale, a section perpendicular to the wires (not illustrated in FIG. 6). FIG. 7 shows also only schematically a section in the area of opening 3 that is not a simple opening but also in the form of projections. In FIG. 7, the size of the opening is deliberately illustrated differently from that in FIG. 1 in order to illustrate the wide size spectrum of the opening.

Of course, it is possible to provide openings 3 in the housing 6 also within the bottom area of the pot 8 or in the area of the second pole piece 11, in alignment with corresponding recesses or cutouts in the pot or the pole piece, in order to obtain the desired acoustic tuning.

While specific embodiments of the invention have been shown and described in detail to illustrate the inventive principles, it will be understood that the invention may be embodied otherwise without departing from such principles.

What is claimed is:

1. A miniaturized sound transducer operating in accordance with the electro-dynamic principle, wherein the sound transducer comprises:

a housing of deep drawn sheet metal having a bottom;

a magnet system comprising a magnet;

a diaphragm provided with a coil;

wires extending from the coil to contacts;

wherein the housing has an outer diameter of maximally 20 mm;

wherein the housing is comprised of thin sheet steel having an average thickness of maximally 0.2 mm;

wherein the magnet system has a lower pole piece and an upper pole piece;

wherein the upper and lower pole pieces are comprised of sheet steel having a thickness of at least 1.5 times an average thickness of the bottom of the housing and wherein the magnet system is composed of the lower pole piece and the bottom of the housing which are in contact with one another over entire surfaces thereof which face each other.

2. The transducer according to claim 1, wherein the upper and lower pole pieces have a thickness of at least 2 times the average thickness of the bottom of the housing.

3. The transducer according to claim 2, wherein the upper and lower pole pieces have a thickness of at least 3 times the average thickness of the bottom of the housing.

4. The transducer according to claim 1, wherein the lower pole piece is part of a magnet pot whose peripheral area extends at least substantially to an upper surface of the upper pole piece.

5. The transducer according to claim 4, wherein the lower pole piece is a monolithic part of the magnet pot.

6. The transducer according to claim 4, wherein a wall thickness of the magnet pot is at least 1.5 times the average thickness of the bottom of the housing.

7. The transducer according to claim 6, wherein the wall thickness of the magnet pot is at least 2 times the average thickness of the bottom of the housing.

8. The transducer according to claim 7, wherein the wall thickness of the magnet pot is at least 3 times the average thickness of the bottom of the housing.

* * * * *